US012448864B1

(12) United States Patent
Wehrenberg

(10) Patent No.: US 12,448,864 B1
(45) Date of Patent: Oct. 21, 2025

(54) CASE GUARD SUBSTANCE AND METHOD OF USE

(71) Applicant: Steve Wehrenberg, Mustang, OK (US)

(72) Inventor: Steve Wehrenberg, Mustang, OK (US)

( * ) Notice: Subject to any disclaimer, the term of this patent is extended or adjusted under 35 U.S.C. 154(b) by 0 days.

(21) Appl. No.: 18/831,391

(22) Filed: Dec. 27, 2024

(51) Int. Cl.
*E21B 33/138* (2006.01)
*E21B 33/12* (2006.01)
*E21B 37/00* (2006.01)

(52) U.S. Cl.
CPC ..... *E21B 33/138* (2013.01); *E21B 33/1208* (2013.01); *E21B 37/00* (2013.01)

(58) Field of Classification Search
CPC .... E21B 33/1208; E21B 33/13; E21B 33/138; E21B 37/00
See application file for complete search history.

(56) References Cited

U.S. PATENT DOCUMENTS 5,712,314 A 1/1998 Surles
10,787,880 B2 9/2020 Wehrenberg
11,578,252 B2 2/2023 Larsen
2005/0025777 A1 2/2005 Pohlmann
2005/0109502 A1 5/2005 Buc Slay
2007/0125276 A1 6/2007 Reddy
2007/0181224 A1 8/2007 Marya
2008/0200352 A1 8/2008 Willberg et al.
2009/0126932 A1 5/2009 Robinson
2015/0239795 A1* 8/2015 Doud ..... E21B 29/02 149/7
2017/0253788 A1 9/2017 Ivanov
2017/0349747 A1 12/2017 Sherman
2018/0265682 A1 9/2018 Roy
2021/0187604 A1 6/2021 Sherman
2021/0348484 A1* 11/2021 Dusterhoft ..... E21B 43/11
2022/0056330 A1 2/2022 Ghebremeskel
2023/0323187 A1 10/2023 Christanti

* cited by examiner

*Primary Examiner* — Kristyn A Hall
(74) *Attorney, Agent, or Firm* — Randal D. Homburg

(57) ABSTRACT

A product and method for temporarily plugging wellbore conductivity using a fibrous swelling elastomeric material mixed with reactive coated alkali metal particles to seal perforated tunnels in a producing wellbore to prevent or minimize frac-hit or frac-bashing from adjacent intersecting wellbores and fracture networks, the product comprising a mixture of granulated particles and fibrous swelling elastomers which are chemically modified to undergo degradation by thermal effects.

6 Claims, 8 Drawing Sheets

CASE GUARD SUBSTANCE AND METHOD OF USE

CROSS REFERENCE TO RELATED APPLICATIONS

None.

I. BACKGROUND OF THE INVENTION

1. Field of Invention

A product and method for temporarily plugging wellbore conductivity using a swelling elastomeric material mixed with a reactive coated alkali metal particle to seal perforated tunnels in a producing wellbore to prevent or minimize frac-hit or frac-bashing to adjacent intersecting wellbores and fracture networks, the product comprising a mixture of granulated particles and fibrous swelling elastomers which are chemically modified to undergo degradation by thermal effects, the introduction of the mixture or fibrous swelling elastomers forced into the perforation tunnels under pressure and at a temperature of 0-100 degrees Fahrenheit, after which removal of the mixture occurs by decomposition using hot water at up to 275 degrees Fahrenheit, causing an additional exothermic rapid decomposition of the alkali metal particle for removal by exothermic physical degradation and ultimate restoration of the wellbore and perforation tunnels.

2. Description of Prior Art

A preliminary review of prior art patents was conducted by the applicant which reveal prior art patents in a similar field or having similar use. However, the prior art inventions do not disclose the same or similar elements as the present granulated and fibrous swelling elastomers and method of use as disclosed herein, nor do they present the material components in a manner contemplated or anticipated in the prior art.

In U.S. Pat. No. 11,578,252 to. Larsen, a method and composition for treatment fluid introduction into a wellbore penetrating a subterranean formation using a liquid composition including a base fluid and composite diverting particulates comprising a degradable polymer and an oil-based material to partially plug a zone in the subterranean formation, serving the purpose of introducing fluid away from the zone. However, there is no intentional degradation of temporary plugging, nor any intended purpose of prevention of damage to adjacent wells contemplated nor anticipated in this patent, nor included steps for thermal degradation combined with a chemical decomposition reaction from high temperature water flushing.

In U.S. Pat. No. 10,787,880 to Wehrenberg, the present inventor identified method for sealing perforation tunnels in a well including the steps of pumping an initial volume of fluid into a well, mixing an expandable material into a carrier fluid to form an expandable fluid mixture, pumping the expandable fluid mixture into the well to force the expandable material into the perforation tunnels in the well, and holding the expandable material under a hold pressure in the perforation tunnels for a cure period to form perforation plugs. Again, this method does not introduce any steps for degradation of the expandable plug materials after cure.

A method is disclosed in U.S. Patent Application Publication No. 2018/0265682 to Roy, which includes polymerizing a blend of materials which include a polymeric material and a. degradable alloy material to form a degradable component from the polymerized blend of materials. Apportion of the method includes exposing the degradable component to water where the degradable alloy material reacts with the water to at least in part degrade the component. It is held for use in sensing operations, drilling operations, cementing operations, fracturing operations and production operations. It requires the use of mechanical plugs to block passages during the method, these plugs having a rubber or silicon seal. The plugs are given by examples as balls, cylinders and form molded flexible parts and seated rings. These are referenced a TPE (thermoplastic elastomers) or NBR or other rubber compounds.

The reactive particle include aluminum, gallium, indium, tin, bismuth, zinc, mercury, lithium, sodium and potassium, in varied shapes, sizes, powders, solids and percentages serving as the degradable alloy component.

U.S. Patent Application Publication No. 2017/0253788 to Ivanov discloses numerous variations of shaped uniform particles included is a treatment fluid, including geometric three dimensional shapes including cylindrical, spherocylinder and polyhedral shapes and tetrahedrons which are degradable and fluids which include proppants, fibers, flakes and particulate materials. These also include particles having a rigid core and a film or fibrous coating.

A method of well treatment is disclosed in U.S. Patent Application Publication No 2008/0200352 to Willberg. It comprises the injection of a slurry of a degradable material, allowing the degradable material to form a plug in one or more perforations, fractures or wellbores in a well penetrating of a formation, performing the downhole operation and allowing the degradable material to partially or fully degrade after a selected duration such that the plug disappears. A polymer appears to be mixed with a particulate to form the degradable material, the polymer selected from lactic acid, glycolide, polylactic acid, polyglycolic acid, and amide, the degradable material is a fiber and the particulate material is a degradable proppant, with an additive to either accelerate or delay the degrading step of the method. The method simply states that the degradation passively occurs, unlike the present degradation caused by heat and water and performed actively.

II. SUMMARY OF THE INVENTION

Currently in oil and gas application, there is a newly encountered problem occurring often with catastrophic consequences of an adjacent wellbore being "frack-hit" or "frack-bashed". These inter-well interference events are caused by nearby fracking activity to which the new fracturing planes intersect adjacent wellbore or existing frack networks to which newly exerted frack pressures are being applied to the adjacent wellbores or fracture matrix. Commonly, this results in complete loss of wellbore access of the adjacent wellbore causing casing collapse in the adjacent well taking the frack-hit and/or complete production loss of the adjacent affected well. This is most commonly exacerbated as more pad well designs or clustered wellbore designs are incorporated into fields, as well as where oil and gas operators are drilling more infill wells. These more commonly designs are generally the result of a more efficient extraction of oil and gas productions and extension of existing wells into new production sources.

In order to minimize the frack-hit or frack bash to existing adjacent wellbores or commonly shared fracture zones, above and below the new fracking occurrences, a new temporary swelling elastomer agent is applied to all open perforation tunnels in the producing wellbore (Parent Well), for a period to allow the swelling elastomeric agent to undergo a swelling time wherein the temporary plugging of all perforations are sealed off. After this pugging has occurred, pressure is applied to the Parent Well equal to the frack treating pressure of an adjacent well (Child Well) being fracked. Once the pressure is equal, negative effects of any potential frack hit have eliminated and the fracking can occur without any negative effect to the Parent Well due to the plugging of the perforations using the temporary swelling elastomer. After the fracking in the Child Well has concluded, the pressure is removed from both the Parent Well and the Child Well, wherein a degradation process may occur by the introduction of a heated water source, causing rapid degradation of the temporary swelling elastomeric agent reducing it to restore the original perforations, decay and decompose into small fragments and upon the release of the pressure, be expelled into the water and removed from the Parent Well through the perforation tunnels.

It is contemplated that the temporary swelling elastomeric agent would be enhanced by a particulate fibrous component that could include alkali metal core particles encased in an elastomeric chemical to form the temporary swelling elastomeric agent which has quality of swelling when placed in an ambient temperature quantity of water prior to introduction into the wellbore with a limited period of time to swell, complete its swelling and then decay over a contemplated period of time which can be accelerated upon exposure to a hot water source using temperature which can be retrieved from the downhole area of the well or introduced at the surface using available heat sources, which causes the temporary swelling elastomeric agent to be broken up, exposing the alkali metal core particles, causing the alkali metal core particle to rapidly "explode" by a chemical exothermic reaction. It is also contemplated that a non-reactive fibrous material can be mixed into the temporary swelling agent to act as a binder to form a mixture of the temporary swelling elastomer agent or the elastomer chemical coated alkali metal core particles.

It is also contemplated that secondary positive attributes can occur to the formation lithology. It is theorized that by pressuring upon the Parent Well casing, small capillary fractures may close up, which can lead to an increase in the reservoir pressure, which can positively effect on the nearby Child Well, as well as leading to beneficial results to the entire geological formation production and oil recovery operations nearby.

III. DESCRIPTION OF THE DRAWINGS

The following drawings are submitted with this utility patent application.

FIG. 6 is a diagram of the shaped alkali metal particles with a polymeric coating and the elastomeric granular swelling materials and fiber being introduced to the well bore and perforation tunnels at a swelling phase temperature.

FIG. 8 is an isolation view of a perforation tunnel having the shaped alkali metal particles with the polymeric coating material and the elastomeric granular swelling material and fiber packed into the perforation tunnel under pressure prior to a full swelling and full pressuring phase.

FIG. 9 is an isolation view of a perforation tunnel having the shaped alkali metal particles with the polymeric coating material and the elastomeric granular swelling material and fiber at the time of full swelling and maximum pressuring phase.

IV. DESCRIPTION OF THE PREFERRED EMBODIMENT

A casing guard swelling mixture 10 is utilized in a new process for supplying the temporary swelling mixture 10 or a swellable material applied to open perforation tunnels D in a primary wellbore A of a production well X during a temporary and a pre-calculated period of time to allow the swelling mixture for the temporary plugging of all perforation tunnels D within the primary producing wellbore A to be sealed off while an adjacent secondary wellbore is being pressurized for fracking to protect the primary producing wellbore A, perforation tunnels D and existing production. After this plugging process has occurred, pressure is applied to the production well X primary producing wellbore A equal to a frack treating pressure of the adjacent secondary frack wellbore prior to the adjacent secondary frack wellbore being fracked to prevent damage to the production well X primary producing wellbore A, its casing B, concrete C and perforation tunnels D within the wellbore A and surrounding oil and gas geologic production layers E. The casing guard material 10 swelling mixture is provided using a combination of an elastomeric granular swelling material (EGSM) 20, a coated alkali metal particle (CAMP) 30 surrounded by a degradable polymeric coating material 32 and a fibrous material (FM) 40.

The casing guard material 10 comprises the EGSM 20 combined with the FM 40 that is chemically engineered and modified to undergo degradation within the parent well by thermal effects of hot water supplied through the wellbore A bottom hole temperatures (BHT) after the calculated period of time necessary to complete the fracking of the adjacent well mixed with a quantity of CAMP 30 encased in the pre-calculated degradable polymeric coating material 32.

The parameters of the initial thermal temperature of the EGSM 20 and CAMP 30 would include a swelling phase temperature (SPT) at an ambient temperature between 0-100° F. during its introduction into the targeted perforation tunnels D of the production well X. After a brief period of time allowing the EGSM 20 to swell and bind the CAMP 30 particles to forcibly set and pack the mixture into the wellbore casing B, concrete C, perforation tunnels D and fracked portions within the production layers E until the adjacent fracking has concluded. Final stabilized pressure is subsequently added to the parent well once the EGSM 20 has been thoroughly saturated and plugged to a hardened state within the perforation tunnels holding a stabilized pressure in the production well X equal to the maximum fracking pressure of the adjacent well.

Figure 4:
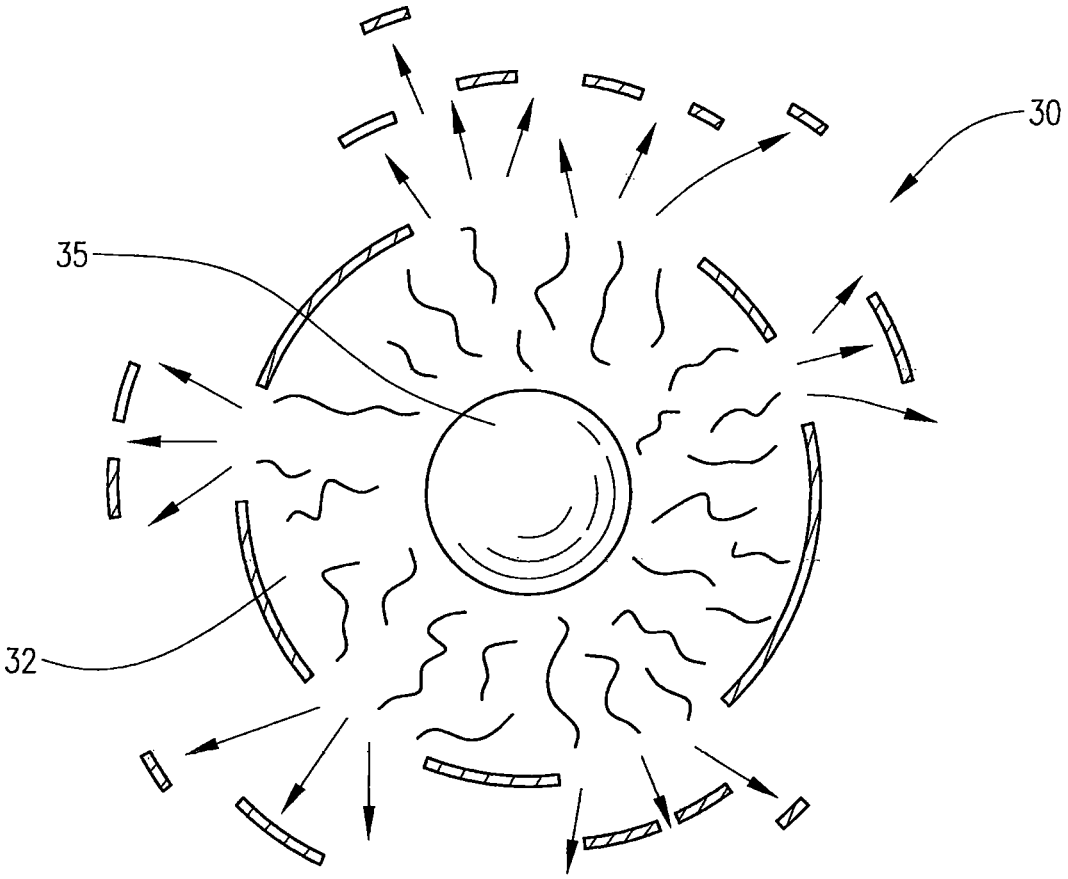
FIG. 4 is a diagram of the exposed metal alkali particle once the elastomeric coating is dissolved, exposing the alkali metal particle to the hot water causing an exothermic chemical reaction at the moment of rapid explosion.
Figure 3:
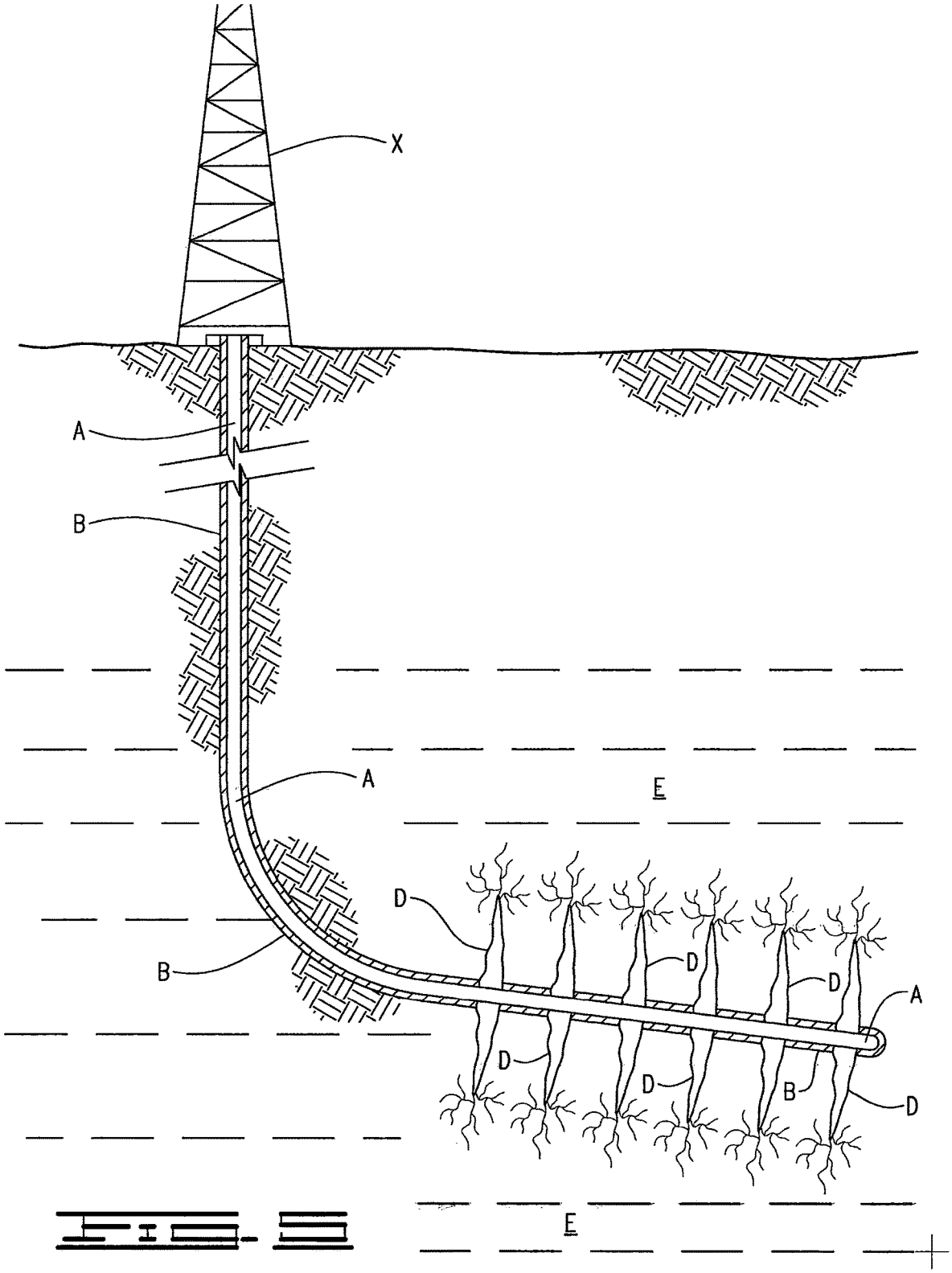

Upon completion of the adjacent fracking and release of the fracking pressure on the adjacent well, heated circulating water is introduced into the production well X and circulated through the bottom hole that has a high BTH up to 275° F. to heat circulated water to a degradation catalyst temperature (DCT) to compel the degradation of the EGSM 20 and expose and activate the CAMP 30 causing the now exposed alkali metal core particle 35 to thermally react and explode, FIG. 4, destabilizing the EGSM 20 and CAMP 30 for removal of the decomposed EGSM 20 remnant and remaining mixture from the production well X and its perforation tunnels D, further flushing the EGSM 20 from the production well X and restoring production. The specific scenario is premeditated to have a predicted and intentional failure date when the degradation process is to occur, expedited by the introduction of the heated circulated water.

Another way the EGSM 20 can be amended to further expedite the degradation process is in the initial formation of the particulate elastomeric granular temporary swelling material is by the engineering of each CAMP 30 by taking the alkali metal core particle 35 and encase it within the degradable polymeric coating material 32 which has the chemical and physical property to bind to the alkali metal core particle 35 with the degradable polymeric coating material 32 having a predictable and predetermined decay rate prior to exposing the inner alkali metal particle 35. This is further mixed with the FM 40 acting as a binder to thicken the EGSM 20 to enhance the temporary purpose of sealing off the perforation tunnels D of the production well X during the adjacent fracking process within the adjacent well to protect the production well X. This reaction of the exposed alkali metal core particle 35 is anticipated to enhance the degradation process by the degradable polymeric coating material 32 being dissolved by the exposure to the heated water until penetration of the coating has been achieved, exposing the alkali metal core particle 35 to the hot water causing an exothermic chemical reaction which is known and calculated by those skilled in the art of physical chemistry, resulting in a small fragmentation explosion of each alkali metal core particle 35 to break the physical binding of the EGSM 20 and fibrous materials 40, leading to a rapid breakup of the EGSM 20 and the other nearby degradable polymeric coatings 32, further exposing their respective alkali metal core particles 35 in a chain reaction.

This disclosed product and process leads those skilled in the art to not only perceive a new and unique process for use of the EGSM 20, CAMP 30, and FM 40 mixture to protect existing production wells X from adjacent well fracturing events, but also employing a new and useful product which is introduced into the production wellbore A and perforation tunnels D protecting the adjacent production well X and its geological production layers E and surrounding structural zones from damage during the adjacent well fracking process which degrades at a predetermined and calculated time coinciding with the fracking process completion accelerated by the introduction of heated circulating water, especially when the casing guard material comprises the elastomeric granular temporary swelling materials 20, the alkali metal core particles 30 and the fibrous binding material 40 as further defined below.

The elastomeric granular swelling material 20 is a swellable water soluble composite allowing actuating and large changes in physical structure while degradable in light, pH, temperature or electric fields. They are used in products as simple as diapers, to absorb moisture and as complex as material desiccation and as a drying agent. In the present EGSM 20, this hydroelastomer is the principle additive in this product and process, being known in the industry for its material creation potential, its stiffness, its fracture energy (especially in silicon composites), its dissolution when exposed to heated water and its wide variety of applications, including molding formations, complex 3D shapes, FIG. 3, and temporary and permanent expansion sealants.

The fibrous material 40 contemplated within the scope of the mixture used in the process and combining to form the product becomes woven with the EGSM 20 and acts as a binding matrix as the EGSM 20 swells and becomes lodged within the perforation tunnels D, and fractured portion of the geological formation E and the pipeline locations which have been penetrated to form the multiple perforation tunnels D. The preferred fibrous material would be a non-continuous fiber so that it is easily dispersed upon degradation of the EGSM 20 within which it is woven for forming the binding matrix. They may be natural or synthetic fibers which pose no environmental or health hazard, excluding products containing fiberglass or asbestos, mostly selected from plant or animal sources. Examples of naturally occurring fibers useful in the product mixture with the EGSM 20 are cotton, wool, jute, sisal vegetable fiber or hemp. Useful synthetic fibers can be provided as basalt, nylon, polyester, or wollastonite, all the above noted for their tensile strength when used in other products. These fibrous materials 40 have been used for strengthening concrete in the same manner as would be anticipated in the EGSM 20.

Figure 1:
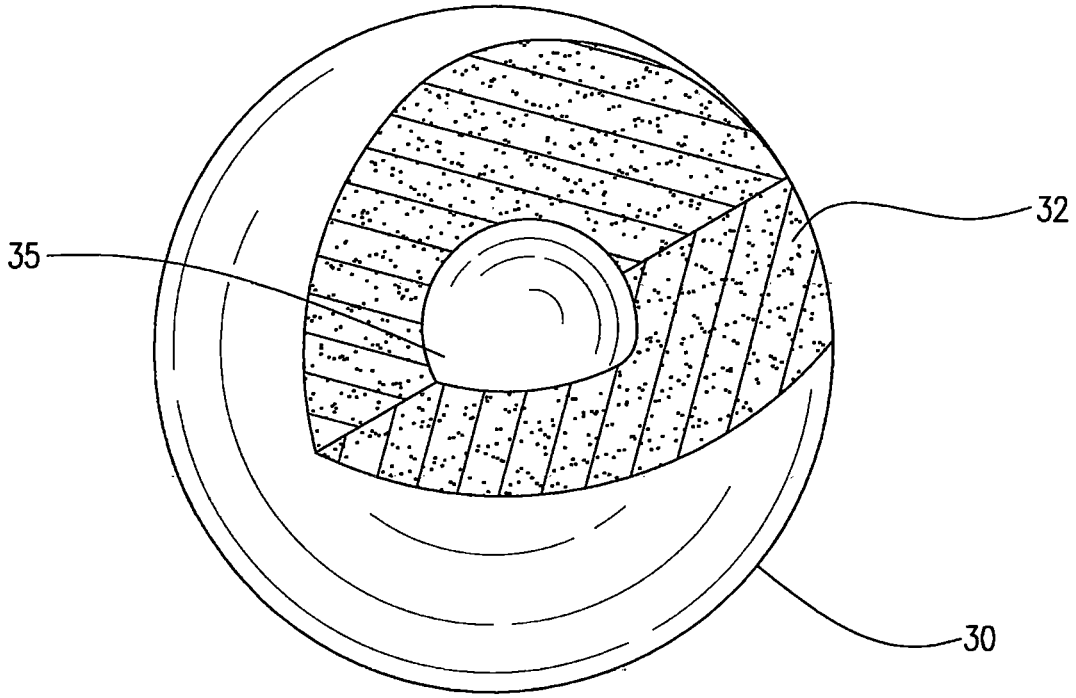
FIG. 1 is sectional view of an embodiment of a spherical shaped alkali metal core particle with a polymeric coating material.

The alkali metal core particles 35, FIG. 1, which would be contemplated for the process would include lithium, sodium, potassium, cesium, francium, and rubidium, and non-alkali metals including magnesium, barium, and calcium, all of which react with water to create an exothermic and degeneration of compounds within which they are found. Monoxides ($M_2O$), peroxides ($M_2O_2$) or superoxides ($MO_2$) and their generic equivalents may also be use, as well as alkaline methyl hydrides which are disrupted by water. The degradable polymeric coating material 32 in the CAMP 30 is a coating material that degrades over time at a predictive rate, allowing for different timed degradation of the coating material based upon thickness, viscosity or hardness during exposure to liquids and more thermal degraded in direct proportion to the level of temperature of the water to which it is exposed. Those skilled in the art will be able to base the selection of the CAMP 30 which may be supplied in various time related supplies, most preferably from a single day to several days depending on the predicted time required to frac the adjacent well.

Figure 2:
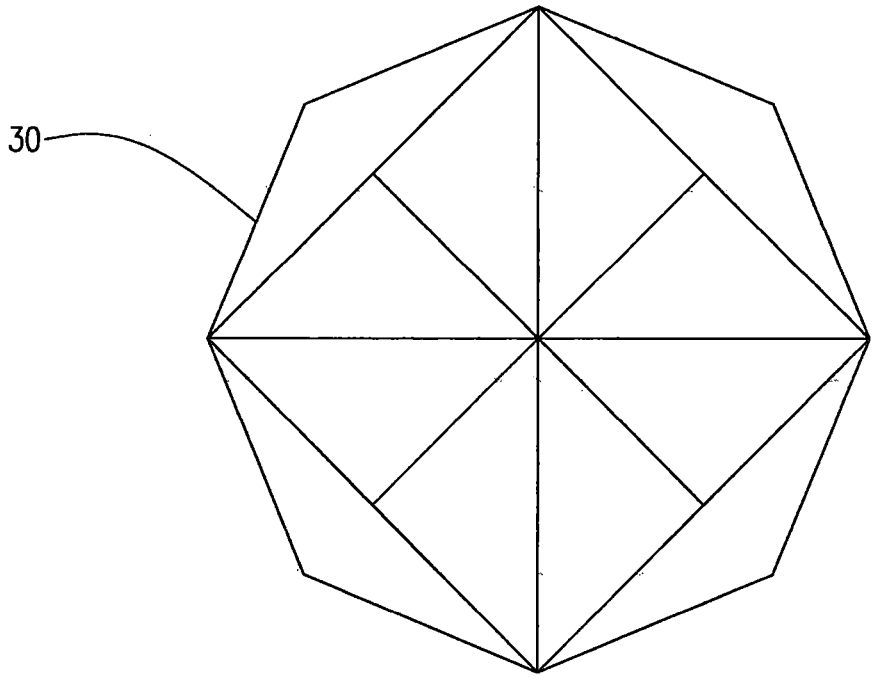
FIG. 2 is an embodiment of an external view of an alternate geometrical shaped alkali metal core particle with a polymeric coating material.
Figure 3:
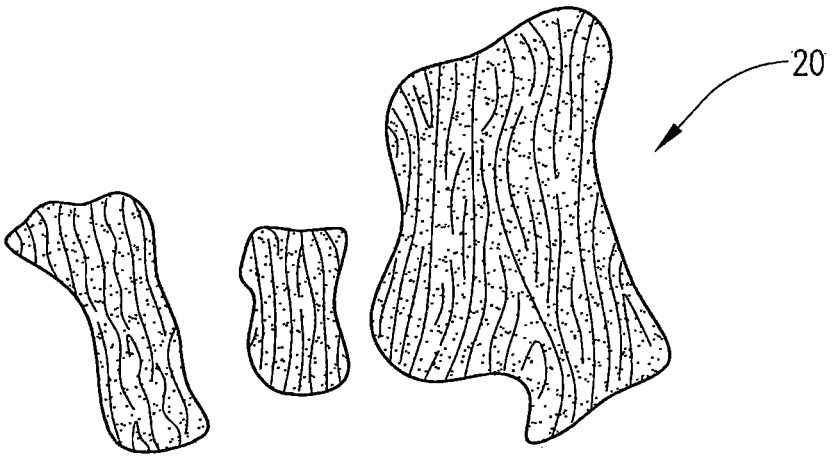
FIG. 3 is an elastomeric granular swelling material in a variety of sizes.

Additionally, it is contemplated that the CAMP 30 can be provided is a specific uniform shape, FIG. 1, or complex geometric shape, FIG. 2, which may aid in the cohesion in forming the CAMP, FIGS. 1-3, as it forms the plug in the penetration tunnels D, casings B and geological formations and production layers E, especially when the shape includes multiple and complex association of flat surfaces or "corners", making is more difficult to displace randomly once applied and forming the plug.

Figure 5:
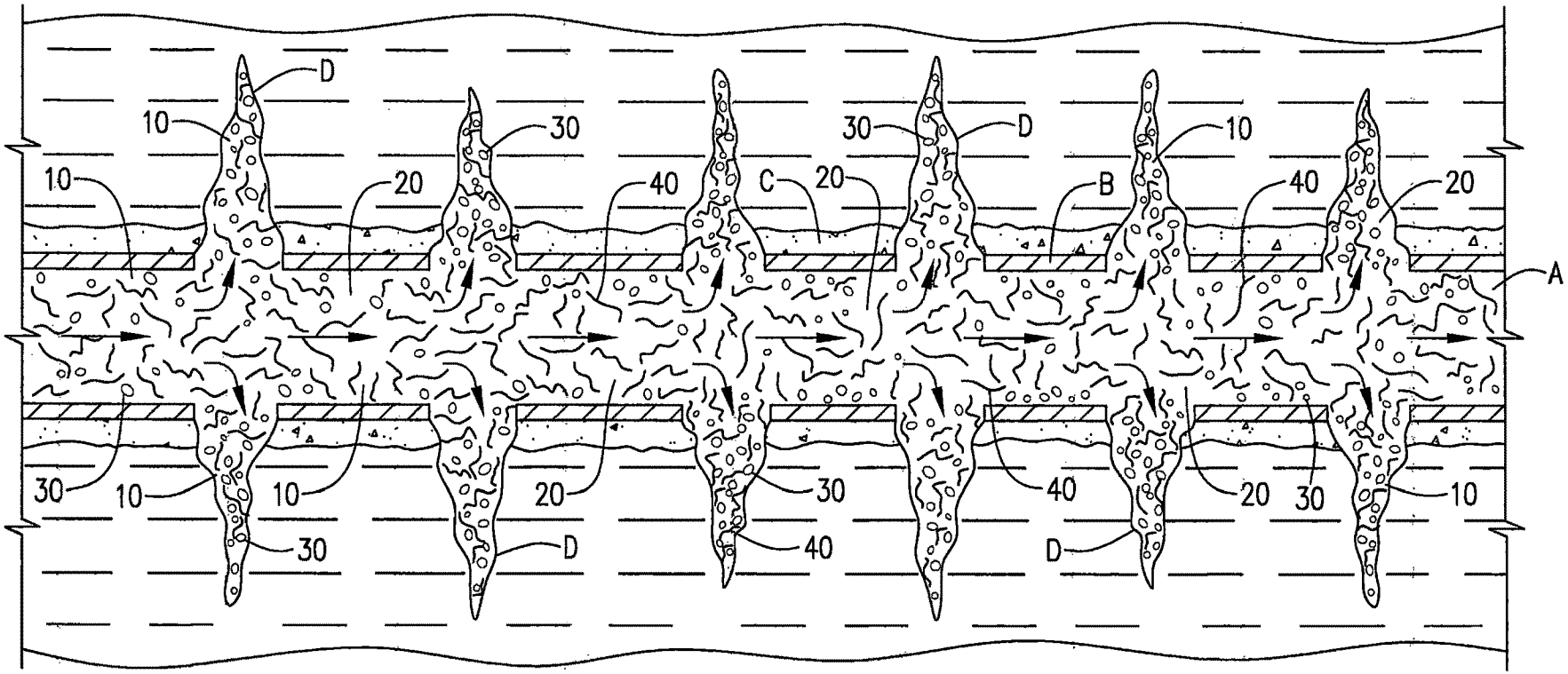
FIG. 5 is the wellbore and penetration tunnels after the initial cleaning of the wellbore after the production fluids are removed.

The process involved in use of this EGSM 20, CAMP 30 and/or FM material 40 mixture, in a production well X, as shown in FIGS. 6-10, would comprise steps as follows:

Prior to sealing, clean the subject well to clear any production fluids within the wellbore A, casing B, concrete C and perforation tunnels D, FIG. 5. Mix the EGSM, CAMP and fiber into a homogeneous mixture. This mixture is then forced into the production well X, under pressure, FIG. 6, and directed to all perforation tunnels D in the casing B and concrete C until the wellbore A is capable of sustaining a pressure equal to that of the well being fracked under pressure, FIGS. 7-8. The pressurized injection mixture is allowed time to swell under pressure at a swelling phase temperature to completely fill all the perforation tunnels D, intruding as far as the fracture zones in the geological formation and production layers E from which the oil and gas is set, FIG. 9. Once swollen to capacity and allowed time to cure and set, pressure is introduced into the primary well equal to the contemplated pressure being applied to an adjacent well during a fracking procedure. Upon completion of the fracking procedure in the adjacent well, the pressure on the primary well is release and hot water is circulated throughout the well, heating the water to the bottom hole temperature to accelerate the already commenced decomposition of the EGSM 20, CAMP 30 and fiber mixture 40, FIG. 10. When the alkali core metal particles 35 become exposed to the hot water, an extremely rapid decomposition of the alkali core metal particles 35 occurs as an exothermic reaction, FIG. 4, rapidly destabilizing the EGSM 20 and fiber composition 40 into lose small particles, FIG. 10, which are then flushed out of a removed from the primary production well X to restore the formation flow of the oil and gas through the perforation tunnels D and the wellbore A. The production of the wellbore A and perforation tunnels D is them reestablished to its production state existing prior to the process being commenced.

Figure 7:
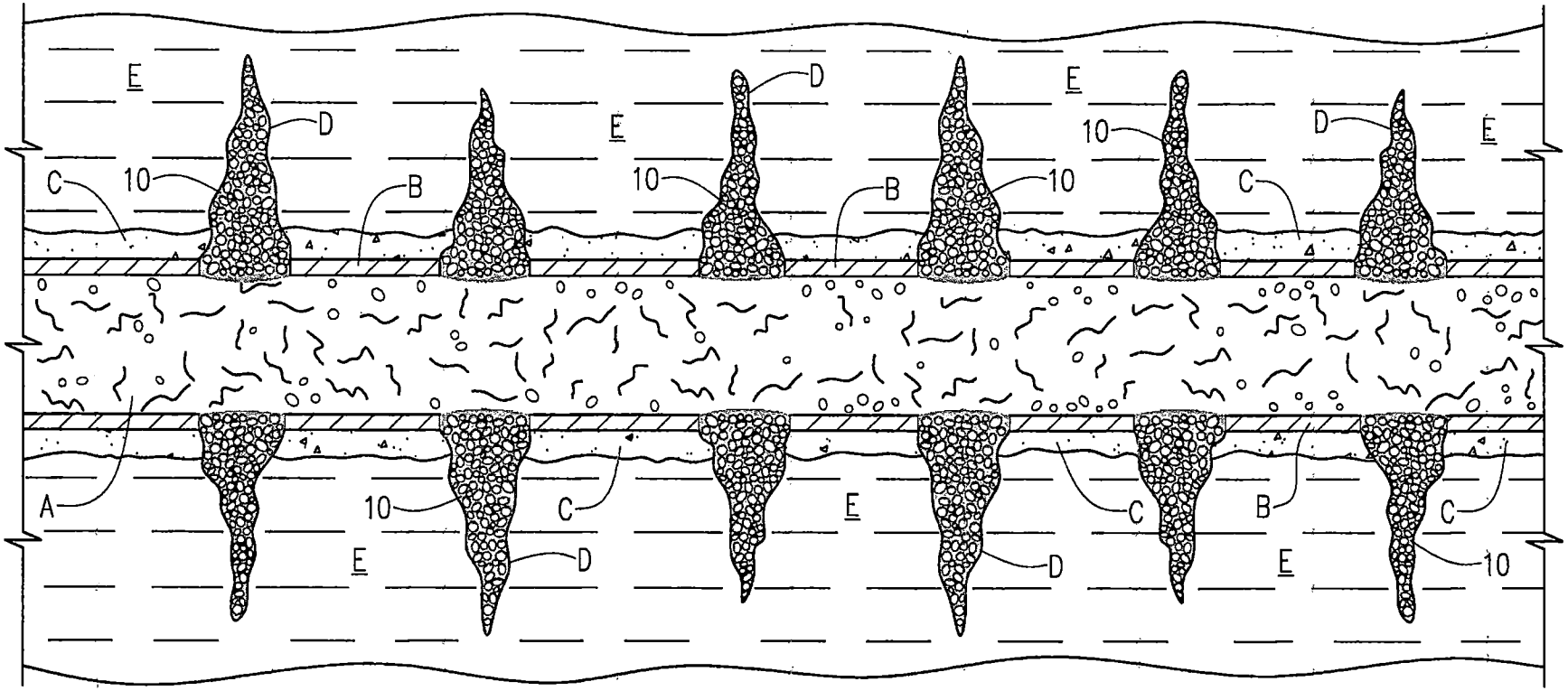
FIG. 7 is a diagram of the shaped alkali metal particles with the polymeric coating material and the elastomeric granular swelling material and fiber being pressure packed into the perforation tunnels to seal them off.
Figure 5:
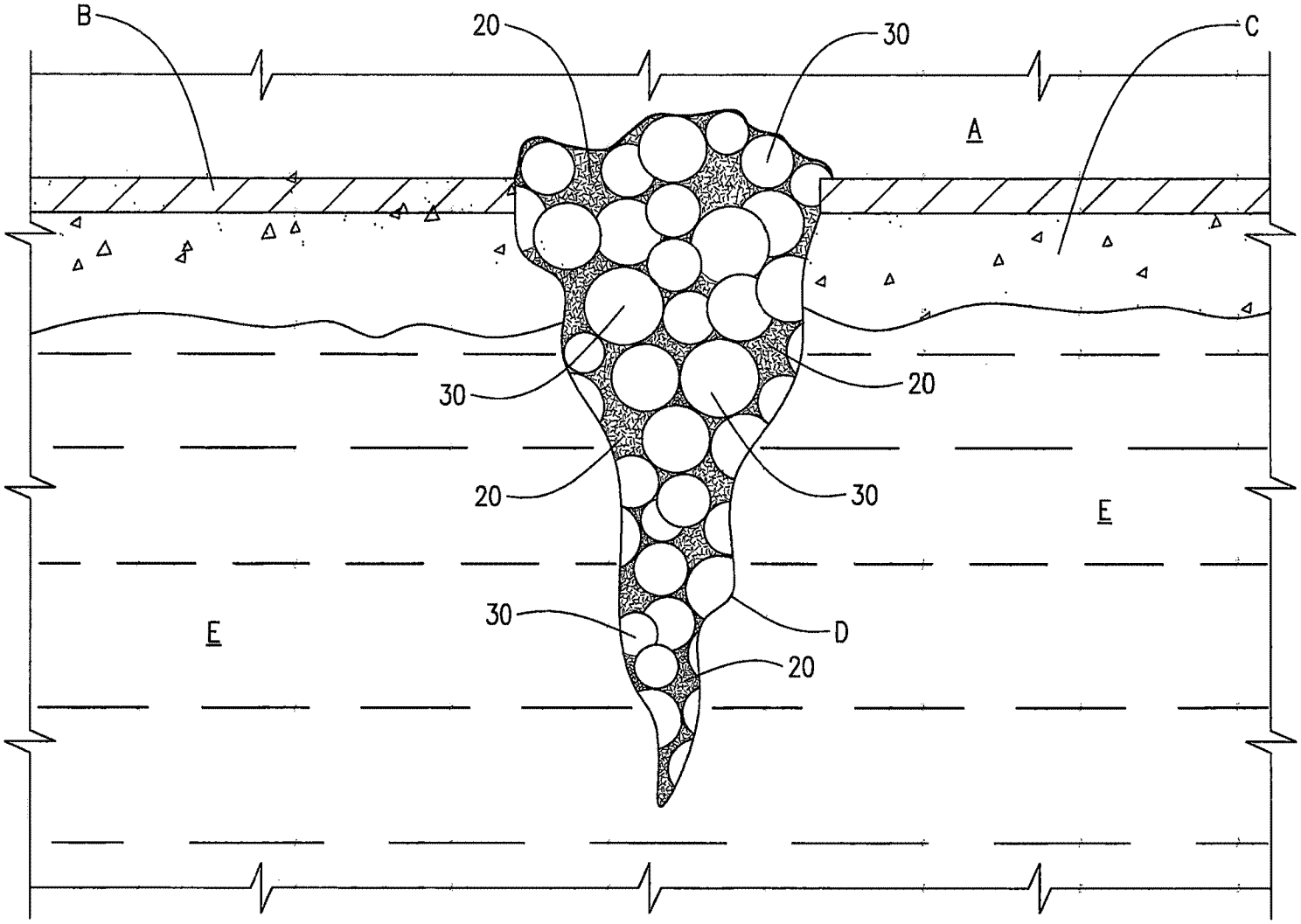
Figure 3:
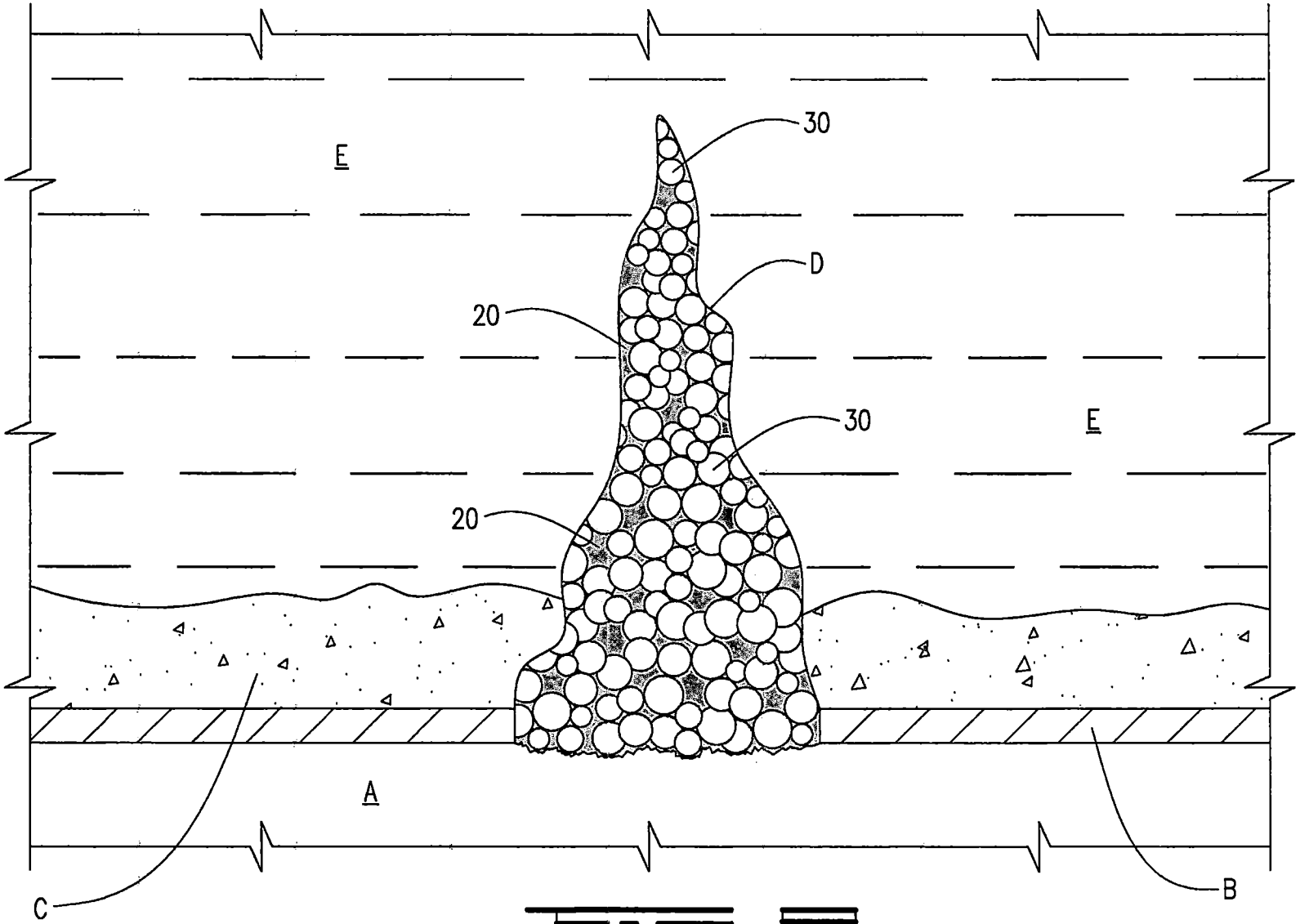
Figure 10:
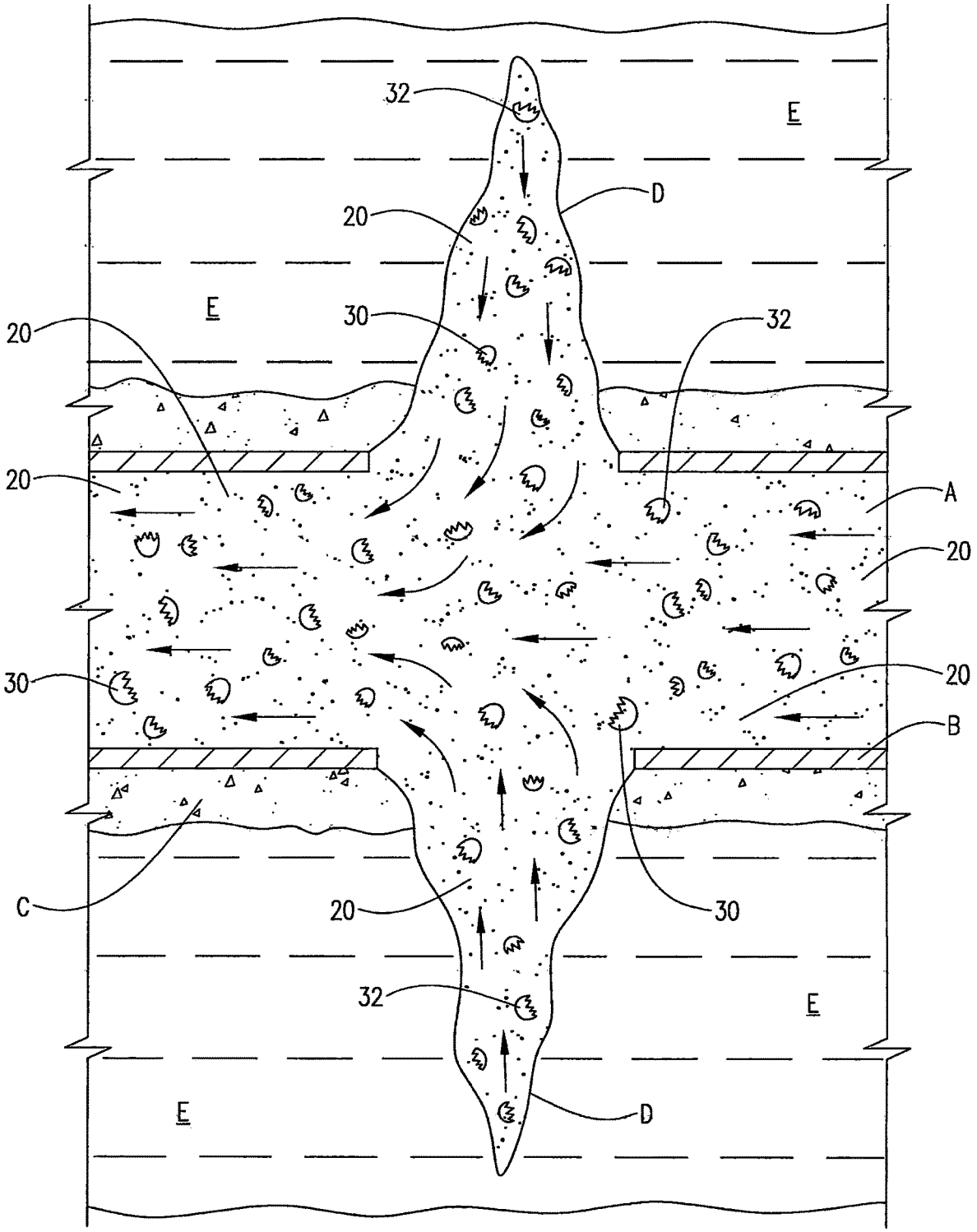
FIG. 10 is a diagram of the removal of the exploded shaped alkali metal particles from FIG. 4, along with the elastomeric granular swelling material and fiber being evacuated from the well bore and perforation tunnels prior to restoration of production flow to the well bore.

The EGSM 20, CAMP 30 and fibrous material 40 sealing process include shutting off pressure conductivity to the primary well transferred through the common formation production layers E, providing a rapid swell rate, providing intentional degradation in a calculated time period EGSM 20, CAMP 30 and fibrous material 40 mixture which can be removed upon completion of the fracking process of the adjacent well, adding a potential exothermic reaction using the alkali metal core particle 35 within the CAMP 30 to enhance the degradation process, FIG. 4, use of the fibrous material 40 with the EGSM 20 to provide a stronger matrix formation to the EGSM 20, eliminating conductivity to the primary well formation by packing in, FIG. 9, screening of a bridging off perforation tunnels D in the primary well, and providing the EGSM 20 in the annular space between casing and production layers E, FIG. 7, to the open hole should a Bernoulli effect carry the material there, packing off fractures and fracture swarms if present.

While the invention process has been particularly shown and described with reference to a preferred embodiment thereof, it will be understood by those skilled in the art that changes in form and detail may be made therein without departing from the spirit and scope of the invention.

What is claimed is:

1. A method for sealing off a production well to protect the production well from damage to said production well, wellbore, casing, concrete surrounding said casing, and perforation tunnels through said casing, concrete and into existing production layers in substrate through which said production well shares with an adjacent oil or gas well intending to be fracked with high pressure in order to protect said production well and production layers from, Frac Hit damage or collapse, using said method comprising the steps of:

ceasing production of oil or gas from the production well;

cleaning an oil or gas from the wellbore, casing, concrete, perforation tunnels and production layers to remove said oil or gas residuals;

mixing a quantity of an elastomeric granular swelling material, an initial coated alkali metal particle, and a fibrous material forming a homogeneous quantity mixture, wherein the initial coated alkali metal particle having an alkali metal core particle and a degradable polymeric coating material with a predictable rate of decay prior to exposing said alkali core particle in the presence of hot water;

injecting said homogeneous quantity mixture under force into said production well directed through the well bore into the casing through the perforation tunnels into the concrete and production layers;

further applying pressure of the homogeneous quantity mixture into said production well until a downhole pressure has reached a desired target pressure level equal to or greater than a calculated fracking pressure which is applied to an adjacent well sharing a common production layer;

allowing said elastomeric granular swelling material within said homogeneous quantity mixture to expand and swell;

further allowing said homogeneous quantity mixture to cure and set to form a hardened seal to withstand said production well target pressure level, sealing said perforation tunnels, and all portions of said production layers through which production tunnels have exposed and penetrated;

performing a pressure fracking procedure on at least one of the one or more adjacent wells while maintaining the downhole pressure on said production well at or greater to the desired target pressure level of the one or more adjacent wells;

releasing the pressure applied on the production well to maintain the downhole pressure after the pressure fracking procedure has been performed on the one or more adjacent wells;

circulating a flushing quantity of hot water obtained from a bottom hole of the production well to decompose said degradable polymeric coating material surrounding said alkali metal core particle, wherein said alkali metal core particle exposed to said hot water undergoes a rapid decomposition and an exothermic reaction to rapidly destabilize said cured and set homogeneous quantity mixture; and flushing destabilized broken particles and material residue of said homogeneous quantity mixture from said well bore perforation tunnels, communicating production layers and casing until said destabilized broken particles and material residue of said homogeneous quantity mixture is removed; and restoring a flow of oil and gas materials into the production wells, said restoration of flow of oil and gas having been protected by the disclosed method of protection afforded by said method.

2. The method as disclosed in claim 1 further comprising:

said elastomeric granular swelling materials plugs said perforation tunnels and production layers that all conductivity is removed between said casing and said perforation tunnels and production layers.

3. The method as disclosed in claim 1 further comprising:

said elastomeric granular swelling materials define an accelerated swell rate in the presence of water, brine or hydrocarbons.

4. The method as disclosed in claim 1 further comprising: said elastomeric granular swelling materials are degraded intentionally when exposed to high temperatures water, up to 275° bottom hole temperature circulated water, and chemical action creating an exothermic reaction subsequent to the exposure of said alkali metal core particle to said heated water.

5. The method as disclosed in claim 1 further comprising: said coated alkali metal particles are selected from a group of shapes including spherical, irregular geometrical shapes, shapes with multiple surfaces and facets, non-uniform shapes, uniform shapes, and having different sizes and a mixture of shapes.

6. The method as disclosed in claim 1 further comprising: said fibrous materials is selected from a group of materials comprising natural fiber, synthetic fiber, organic fiber, inorganic fiber, a mixture of fibrous materials, a uniform mixture of fibers, or waste fiber materials.

* * * * *